US007946000B2

(12) United States Patent
Saeger et al.

(10) Patent No.: US 7,946,000 B2
(45) Date of Patent: May 24, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Nicole Saeger, Aachen (DE); Thomas Schmitz, Mönchengladbach (DE); Johannes Bossmann, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 390 days.

(21) Appl. No.: 12/147,906

(22) Filed: Jun. 27, 2008

(65) Prior Publication Data

US 2009/0000065 A1 Jan. 1, 2009

(30) Foreign Application Priority Data

Jun. 29, 2007 (DE) ..... 10 2007 030 471
Jun. 29, 2007 (DE) ..... 20 2007 010 686 U
Dec. 7, 2007 (DE) ..... 10 2007 059 250

(51) Int. Cl.
*D01G 19/00* (2006.01)

(52) U.S. Cl. ..... 19/217

(58) Field of Classification Search ..... 19/115 R, 19/128, 215, 216, 217
See application file for complete search history.

(56) References Cited

U.S. PATENT DOCUMENTS 1,408,780 A * 3/1922 Schleifer ..... 19/217
1,425,059 A * 8/1922 Schleifer ..... 19/217
1,694,432 A * 12/1928 Schleifer ..... 19/217
1,708,032 A * 4/1929 Schleifer ..... 19/217
1,715,473 A * 6/1929 Schleifer ..... 19/217
1,799,066 A * 3/1931 Schleifer ..... 19/217
2,044,460 A 6/1936 Bartram et al.
2,962,772 A 12/1960 Draving et al.
3,108,333 A * 10/1963 Schleifer ..... 19/235
4,270,245 A 6/1981 Stewart et al.
5,007,623 A 4/1991 Unkuri et al.

(Continued)

FOREIGN PATENT DOCUMENTS

DE 367482 C 1/1923

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus for the fiber-sorting or fiber-selection of a fiber bundle comprising textile fibers, especially for combing, which is supplied by means of supply device to a fiber-sorting device, especially a combing device for removal of the combed fiber material at least one take-off means with a sliver-forming element is present, downstream of which is a drafting system to enable productivity to be substantially increased and an improved combed sliver to be obtained, downstream of the supply device there is arranged at least one rotatably mounted roller rotating rapidly without interruption, which is provided with clamping devices for the fiber bundle, which clamping devices are distributed spaced apart in the region of the periphery of the roller and the combed sliver formed is arranged to be supplied directly to the drafting system.

24 Claims, 8 Drawing Sheets

U.S. PATENT DOCUMENTS

| | | | | |
|---|---|---|---|---|
| 5,343,686 | A | 9/1994 | Buchner et al. | |
| 5,404,619 | A | 4/1995 | Jorg | |
| 5,457,851 | A * | 10/1995 | Mondini | 19/115 R |
| 5,502,875 | A * | 4/1996 | Stolz et al. | 19/115 R |
| 5,796,220 | A | 8/1998 | Clapp et al. | |
| 6,163,931 | A | 12/2000 | Leifeld | |
| 6,173,478 | B1 | 1/2001 | Patelli et al. | |
| 6,216,318 | B1 | 4/2001 | Leifeld | |
| 6,235,999 | B1 | 5/2001 | Rubenach | |
| 6,295,699 | B1 | 10/2001 | Temburg | |
| 6,499,194 | B1 | 12/2002 | Gresser et al. | |
| 6,611,994 | B2 | 9/2003 | Bischofberger et al. | |
| 7,173,207 | B2 | 2/2007 | Losbrock et al. | |
| 2002/0124354 | A1 | 9/2002 | Pferdmenges et al. | |
| 2003/0005551 | A1 | 1/2003 | Schurenkramer et al. | |
| 2003/0029003 | A1 | 2/2003 | Breuer et al. | |
| 2003/0070260 | A1 | 4/2003 | Rubenach | |
| 2003/0154572 | A1 | 8/2003 | Pferdmenges et al. | |
| 2004/0040121 | A1 | 3/2004 | Schmitz | |
| 2004/0128799 | A1 | 7/2004 | Hosel et al. | |
| 2005/0076476 | A1 | 4/2005 | Temburg | |
| 2005/0198783 | A1 | 9/2005 | Rubenach | |
| 2005/0278900 | A1 | 12/2005 | Dammig | |
| 2006/0260100 | A1 | 11/2006 | Duda et al. | |
| 2007/0180658 | A1 | 8/2007 | Saeger et al. | |
| 2007/0180659 | A1 | 8/2007 | Saeger et al. | |
| 2007/0180660 | A1 | 8/2007 | Saeger et al. | |
| 2007/0266528 | A1 | 11/2007 | Farber et al. | |
| 2008/0092339 | A1 | 4/2008 | Bossman et al. | |
| 2009/0000064 | A1 | 1/2009 | Saeger et al. | |
| 2009/0000066 | A1 | 1/2009 | Saeger et al. | |
| 2009/0000067 | A1 * | 1/2009 | Leder et al. | 19/115 R |
| 2009/0000068 | A1 | 1/2009 | Saeger et al. | |
| 2009/0000069 | A1 | 1/2009 | Saeger et al. | |
| 2009/0000070 | A1 | 1/2009 | Saeger et al. | |
| 2009/0000071 | A1 | 1/2009 | Saeger et al. | |
| 2009/0000072 | A1 | 1/2009 | Saeger et al. | |
| 2009/0000073 | A1 | 1/2009 | Saeger et al. | |
| 2009/0000074 | A1 | 1/2009 | Bossmann | |
| 2009/0000075 | A1 | 1/2009 | Saeger et al. | |
| 2009/0000076 | A1 | 1/2009 | Bossmann et al. | |
| 2009/0000077 | A1 | 1/2009 | Saeger et al. | |
| 2009/0000078 | A1 | 1/2009 | Saeger et al. | |
| 2009/0000079 | A1 | 1/2009 | Bossmann | |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | A | 10/2005 |
| WO | WO-2006/012758 | A1 | 2/2006 |

OTHER PUBLICATIONS

German Patent Office Search Report, dated Jul. 10, 2007, Issued in related German Patent Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

The present application claims priority from German Utility Model Application No. 20 2007 010 686.6 dated Jun. 29, 2007 and German Patent Application No. 10 2007 059 250.9 dated Dec. 7, 2007, the entire disclosure of each of which is incorporated herein by reference.

BACKGROUND OF THE INVENTION

The invention relates to an apparatus for the fibre-sorting or selection of a fibre bundle comprising textile fibres, especially for combing. In a known apparatus, fibre material is supplied by means of supply device to a fibre-sorting device, especially to a combing device, in which clamping devices are provided, which clamp the fibre bundle at a distance from its free end and a mechanical device is present which generate a combing action from the clamping site to the free end of the fibre bundle in order to loosen and remove non-clamped constituents, such as, for example, short fibres, neps, dust and the like from the free end, wherein for removal of the combed fibre material at least one take-off device with a sliver-forming element is present, downstream of which is a drafting system.

In practice, combing machines are used to free cotton fibres or woollen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre bundle and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre tuft supplied by the nipper assembly, a top comb and a fixed-position detaching device for detaching the combed-out fibre tuft from the nipper assembly. The lap ribbon supplied to the nipper assembly is here fed via a feed cylinder to a detaching roller pair. The fibre tuft protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre tuft is additionally pulled by the needles of a top comb. The top comb combs out the rear part of the detached fibre tuft and also holds back neps, impurities and the like. The top comb, for which in structural terms space is required between the movable nipper assembly and the movable detaching roller, has to be constantly cleaned by having air blown through it. For piercing into and removal from the fibre bundle, the top comb has to be driven. Finally, the cleaning effect at this site of jerky movement is sub-optimal. Owing to the differences in speed between the lap ribbon and the detaching speed of the detaching rollers, the detached fibre tuft is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nipper returns to a rear position in which it is closed and presents the fibre tuft protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers (transport rollers 3), which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed. The fibre slivers F produced at the individual combing heads are delivered over a guide table 14 and by means of a device not shown more specifically—after undergoing a change of direction through 90°—onto a conveyor table T with a non-moving surface and are transferred, lying one next to the other, to a subsequent drafting system S. The fibre slivers are drafted in the drafting system S and subsequently combined to form a common combing fibre sliver FB. As the distance of the eight combing heads from the drafting system increases, the distance to the drafting system increases. The fibre slivers cover a considerable path between delivery by the transport rollers to the combing heads and their introduction into the drafting system, and added to this there is also the deflection of the fibre slivers. The conveying speed of the eight fibre slivers on the conveyor table to the drafting system is matched to the upstream slow combing process and is limited by this, that is, it progresses at relatively low speed. A high, substantially increased conveying speed, in particular without faulty drafts in the eight fibre slivers, is not possible with this conveying device.

SUMMARY OF THE INVENTION

It is an aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

- a fibre-sorting device;
- a supply device for supplying the fibre bundle to the fibre-sorting device;
- a mechanical device for generating a combing action in order to loosen and remove non-clamped constituents from the fibre bundle;
- a take-off device for removal of the combed fibre material from the fibre-sorting device; and
- a drafting system having an inlet and an outlet; wherein the fibre-sorting device comprises, arranged downstream of said supply device, at least two rotatably mounted rollers that, in use, rotate rapidly without interruption, which are provided with clamping devices distributed spaced apart in the region of the periphery of the rollers for clamping the fibre bundle; said take-off device comprises a sliver-forming element for forming a combed sliver and the apparatus is so arranged that the combed sliver formed thereby is supplied directly to the drafting system. For example, the drafting system may be arranged immediately downstream of the sliver-forming element, and in particular in the absence of any intervening processing device.

By implementing the functions of clamping and moving the fibre bundles to be combed-out on at least two rotating rollers, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achievable which had previously not been considered possible in technical circles. A further advantage is that the rotary rotational movement of the rollers with the plurality of clamping devices leads to an unusually rapid supply of a plurality of fibre bundles per unit of time to the first roller and to the second roller. In particular the high rotational speed of the rollers allows production to be substantially increased. To form the fibre bundle, the fibre sliver pushed forward by the feed roller is clamped at one end by a clamping device and detached by the rotary movement of the first roller (turning rotor). The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the second roller (combing rotor) the ends of the fibre bundle are reversed: the clamping device on the combing rotor grips and clamps the end with the long fibres, so that the region with the short fibres projects from the clamping device and lies exposed and can thereby be combed out. The fibre bundles are—unlike the known apparatus—held by a plurality of clamping devices and transported under rotation.

The clamping point at the particular clamping devices advantageously remains constant until the fibre bundles are transferred to the first and second rollers. A relative movement between clamping device and fibre bundle advantageously does not begin until after the fibre bundle has been gripped by the first or second roller respectively and in addition clamping has been terminated. Because a plurality of clamping devices is available for the fibre bundles, in an especially advantageous manner fibre bundles can be supplied to the first and second roller respectively one after the other and in quick succession, without undesirable time delays resulting from just a single supply device. A particular advantage is that the supplied fibre bundles on the first roller (turning rotor) are continuously transported. The speed of the fibre bundle and of the co-operating clamping elements is advantageously the same. The clamping elements advantageously close and open during the movement in the direction of the transported fibre material. The at least one second roller (which is, preferably, a combing rotor) is advantageously arranged downstream of the at least one first roller (which is, preferably, a turning rotor). With the apparatus according to the invention, a substantially increased productivity is achievable. A further particular advantage is that a combed fibre sliver that has been produced without faulty drafts can be conveyed, in a manner optimally adapted to the process, to the drafting system at high and maximum operating speeds. The combed sliver formed can be conveyed directly to the drafting system. The apparatus of the invention may furthermore have one or more of the following advantages:

- no conveyor belt is required,
- the distance over which the material is conveyed to the drafting system may be kept short,
- a free space may be created beneath the machine, in which, for example, sliver cans can be housed,
- the direction of flow of the material within the combing assembly may be in the same direction as the conveying direction to the drafting system,
- to overcome a difference in height, the material flow in the rotor combing machine can be ascending, for example, by virtue of an ascending arrangement of the rotors,
- the available peripheral length on the combing rotor can be increased by the arrangement of the rollers and consequently more combing elements can be mounted,
- the combing machine can be made more compact and less space is required,
- the linear movement during filling of rectangular cans can be carried out beneath the rotors,
- the drafting system can be arranged vertically, horizontally, or inclined in the direction of the material flow.

Advantageously, at least two rollers co-operate to function as a pair of feed rollers (intake rollers) of the drafting system, and at least two rollers co-operate to function as a pair of delivery rollers (outlet) of the drafting system. Advantageously, the take-off device, for example, a take-off roller, is located close to and in the region of an intake roller of the drafting system. Advantageously, the sliver-forming element is located close to and in the region of a sliver funnel of the sliver-deposition device. Advantageously, the delivery rollers of the drafting system are arranged close to and in the region of a sliver funnel of the fibre sliver-deposition device. Advantageously, a fibre sliver-deposition device is arranged downstream of the drafting system. Advantageously, the fibre sliver-deposition device comprises a revolving plate. Advantageously, a sliver entry opening, for example, a sliver funnel, is arranged at the inlet to the revolving plate. Advantageously, a sliver funnel (sliver-forming element) is present at the inlet to the drafting system. Advantageously, the distance between the output of the drafting system and the sliver entry opening of the fibre sliver funnel is short.

In one embodiment, the outlet of the drafting system is arranged above the sliver entry opening. In another embodiment, the outlet of the drafting system is arranged level with the sliver entry opening.

In one embodiment, the drafting system is arranged horizontally. In another embodiment, the drafting system is arranged vertically. In yet a further embodiment, the drafting system is arranged at an angle ($\alpha$, $\beta$), for example, the drafting system may be arranged at an acute angle ($\alpha$) or the drafting system may be arranged at an obtuse angle ($\beta$).

Advantageously, from the outlet of the drafting system the fibre sliver enters the sliver entry opening over a short path (a, b, c). Advantageously, the drafting system is arranged above the coiler plate of the can coiler. Advantageously, the drafting system is arranged between the outer limitation of the revolving plate and the sliver entry opening of the revolving plate. In one embodiment, the drafting system is arranged at a distance (d; e) from the sliver funnel with the delivery rollers, Advantageously, a levelling device with a measuring device for the thickness of the fibre sliver, an electric regulation device and an actuating device are present. The measuring device is, for example, the sliver funnel at the entry to the drafting system. Advantageously, the actuating device is a servo motor for the drive of at least one roller pair of the drafting system. Advantageously, the distance between the output of the drafting system and the sliver entry opening of the revolving plate is short, for example, the distance between the output of the drafting system and the sliver entry opening of the fibre sliver funnel may amount to about 5 to 30 cm.

In one embodiment a 4-over-3 drafting system is used as the drafting system. In another embodiment, a 3-over-3 drafting system is used as drafting system. Advantageously, the drafting system comprises at least a top and a bottom delivery roller, a top and a bottom middle roller and a top and a bottom feed roller. Advantageously, the bottom delivery roller is driven by a main motor. Advantageously, the bottom feed roller and bottom middle roller (III and II) are driven by a variable-speed motor.

In one embodiment, fibre material in the form of a fibre sliver or several fibre slivers is supplied to the rotor combing machine. In another embodiment, fibre material in the form of a lap is supplied to the rotor combing machine. Advantageously, the drafting system is part of an autoleveller draw frame. Advantageously, more than one fibre sliver is arranged to be supplied directly to the drafting system.

Advantageously, the drive motors of the draw frame and the drive motors of the rotor combing machine are connected to a control and regulation device. Advantageously, the distance over which the material is conveyed to the drafting system is kept short. Advantageously, free space is created beneath the machine, in which for example, sliver cans are housed. Advantageously, the direction of flow of the material within the combing assembly is in the same direction as the conveying direction to the drafting system. To overcome the difference in height, the material flow in the rotor combing machine is advantageously ascending, for example, by virtue of the ascending arrangement of the rotors. The available peripheral length on the combing rotor may, for example, be increased by the arrangement of the rollers and consequently more combing elements can be mounted. Thus, the combing machine is advantageously made more compact and less space is required. Advantageously, the linear movement during filling of rectangular cans is carried out beneath the rotors (turning rotor, combing rotor). Advantageously, the take-off roller rotates clockwise. Advantageously, the stripping roller rotates anticlockwise. Advantageously, a support element having a non-moving surface, for example, a metal sheet or the like, is present between take-off roller and intake of the drafting system. Advantageously, the at least two rollers comprise a turning rotor and a combing rotor. The turning rotor and the combing rotor advantageously have opposite directions of rotation. Advantageously, at least one stripping roller is associated with the take-off roller.

In one embodiment, the invention provides an apparatus for combing a fibre bundle in which the fibre-sorting device is a combing device. The non-clamped constituents removed by the combing action of the mechanical device are, for example, short fibres, neps, dust and the like.

The invention further provides a method for the fibre-sorting or fibre-selection of a fibre bundle comprising textile fibres, the method comprising supplying the fibre bundle to a fibre-sorting device comprising a roller having a clamping arrangement, clamping the fibre bundle at a clamping site at a distance from a free end of the fibre bundle, combing the fibre bundle from the clamping site to the free end of the fibre bundle in order to loosen and remove non-clamped constituents from the free end, removing the combed fibre material from the roller, forming the fibre bundle into a fibre sliver; and supplying the fibre silver directly to a drafting system.

The invention further provides an apparatus for the fibre-sorting or fibre-selection of a fibre bundle comprising textile fibres, especially for combing, which is supplied by means of supply device to a fibre-sorting device, especially a combing device, in which clamping devices are provided which clamp the fibre bundle at a distance from its free end, and a mechanical device is present which generate a combing action from the clamping site to the free end of the fibre bundle, in order to loosen and remove non-clamped constituents, such as, for example, short fibres, neps, dust and the like from the free end, wherein for removal of the combed fibre material at least one take-off device with a sliver-forming element is present, downstream of which is a drafting device, characterised in that downstream of the supply device there are arranged at least two rotatably mounted rollers rotating rapidly without interruption, which are provided with clamping devices for the fibre bundle, which clamping devices are distributed spaced apart in the region of the periphery of the rollers, and the combed sliver formed is arranged to be supplied directly to the drafting device.

DETAILED DESCRIPTION OF CERTAIN PREFERRED EMBODIMENTS

Figure 1:
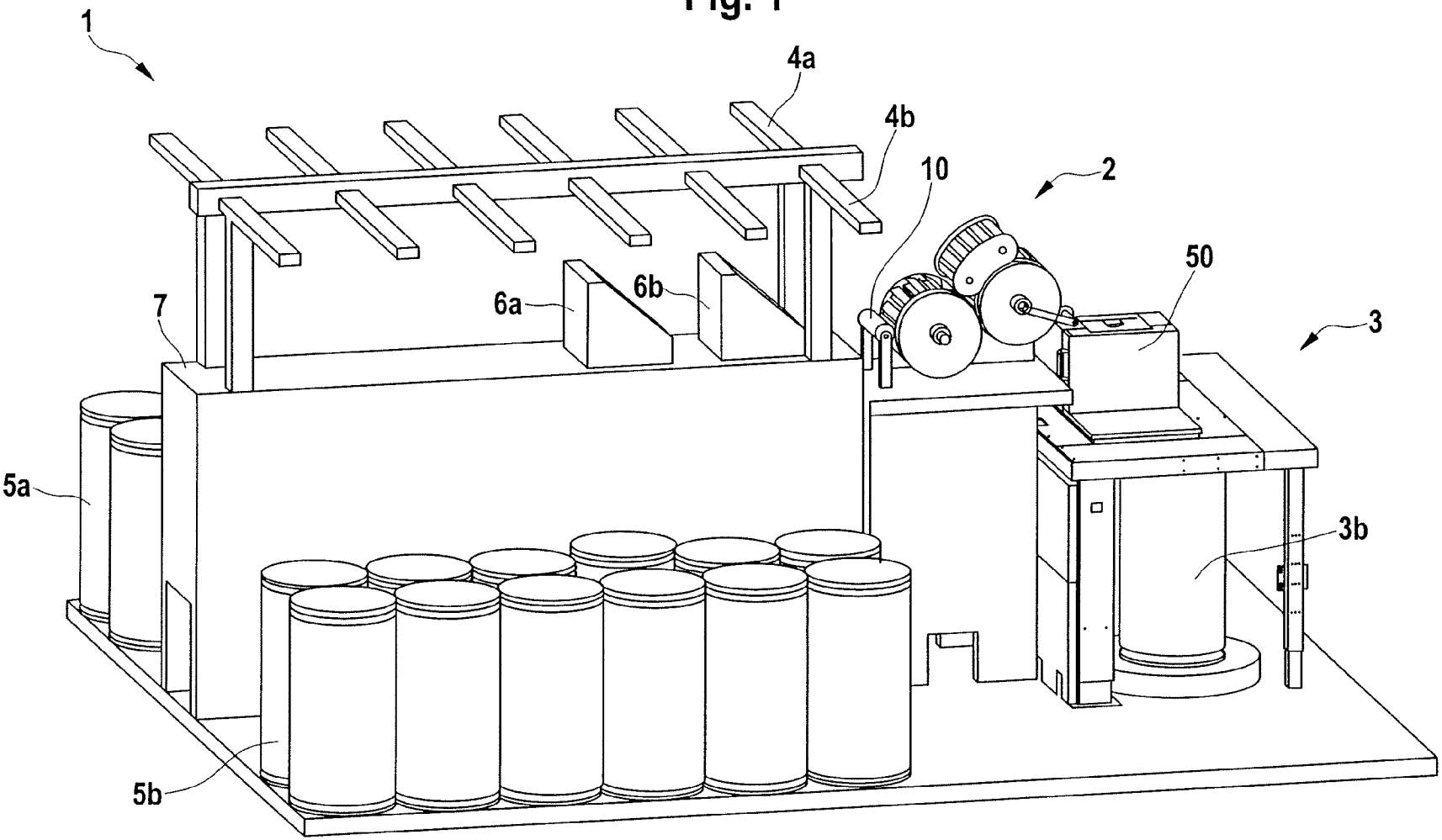
FIG. 1 is a diagrammatic perspective view of a device for combing fibre material, comprising a combing preparation device, a rotor combing machine and a fibre sliver-deposition device.

With reference FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) is doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further construction, more than one rotor combing machine 2 is provided. If, for example, two rotor combing machines and are present, then the two delivered comber slivers 17 can pass together through the downstream autoleveller drafting system 50 and be deposited as one drafted comber sliver in the sliver-deposition device 3.

The sliver-deposition device 3 comprises a rotating coiler head 3*a*, by which the comber sliver can be deposited in a can 3*b* or (not shown) in the form of a can-less fibre sliver package.

Figure 2:
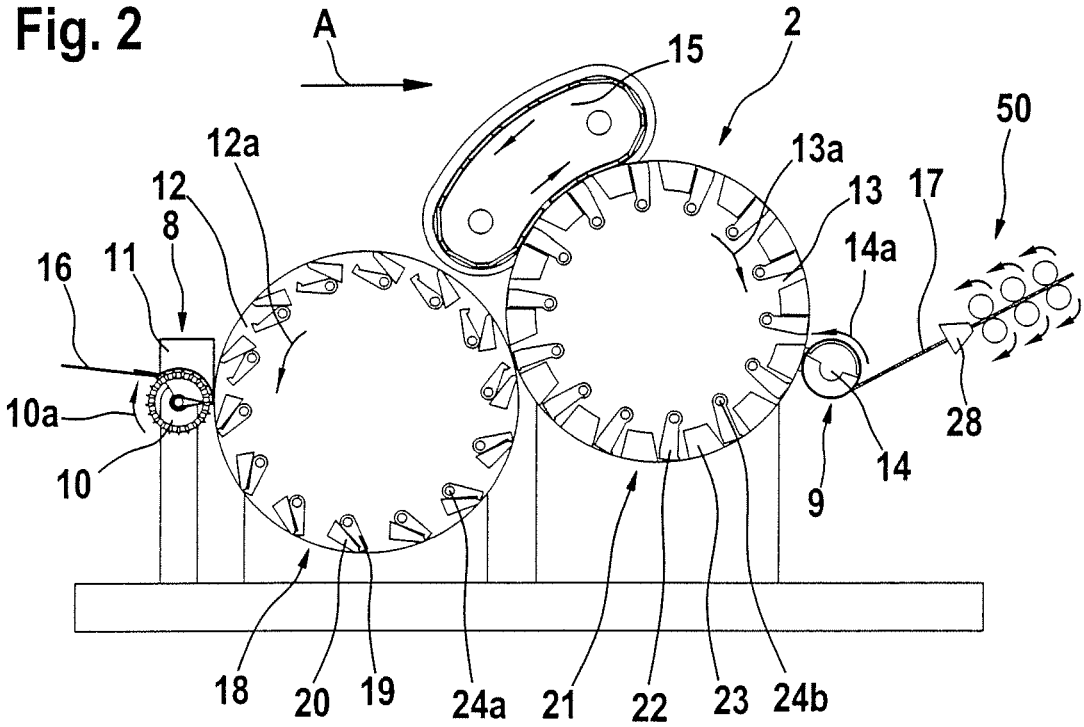
FIG. 2 is a diagrammatic side view of a rotor combing machine according to the invention having two rollers.

FIG. 2 shows a rotor combing machine 2 having a supply device 8 comprising a feed roller 10 and a feed trough 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

Figure 12:
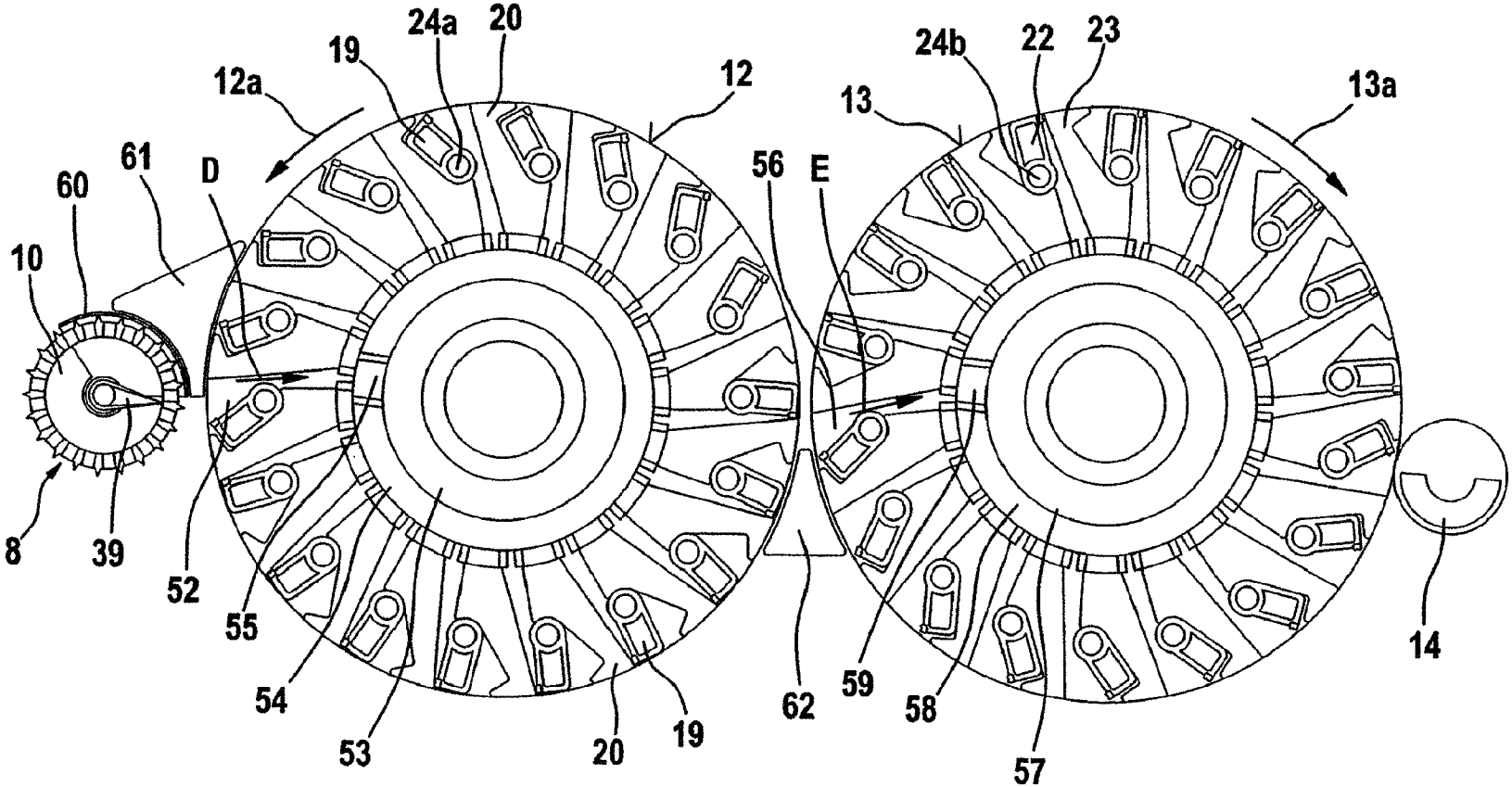
FIG. 12 shows a rotor combing machine according to the invention, in which suction devices are associated with the clamping devices.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre bundle 16 (clamping) and release it (FIG. 12).

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed or movable. The free end of the upper nipper 22 faces the periphery of the roller 13. The upper nipper 22 and the lower nipper 23 co-operate so that they are able to grip a fibre bundle (clamping) and release it. In the case of roller 12, around the roller periphery between the feed roller 10 and the second roller 13 the clamping devices 1 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. A sliver funnel 28 is provided immediately upstream of the intake rollers of the drafting system 50.

Figure 3:
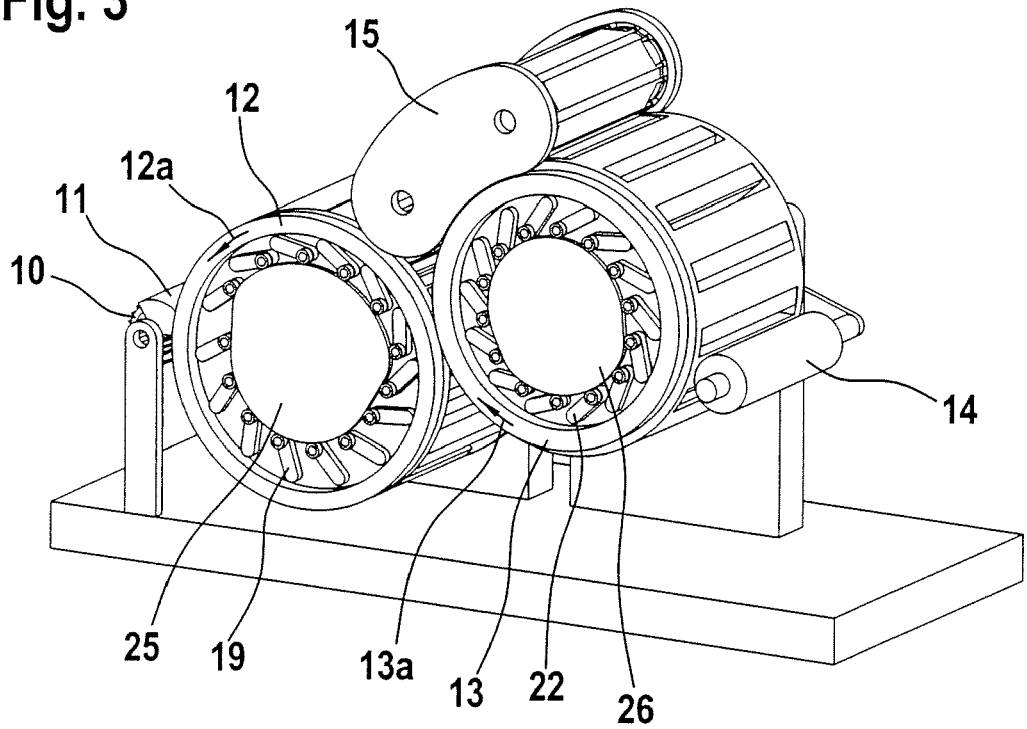
FIG. 3 is a perspective view of the rotor combing machine according to FIG. 2 having two cam discs.

In an arrangement shown in FIG. 3, two fixed cam discs 25 and 26 are provided, about which the roller 12 having the first clamping devices 18 and the roller 13 having the second clamping device 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26 respectively, the upper nippers 19 and 22 are rotated about pivot axes 24*a* and 24*b*, respectively. In that way, the opening and closing of the first clamping devices 18 and the second clamping devices 21 is implemented and the sliver entry opening into the coiler head 3*a* is short.

Figure 4:
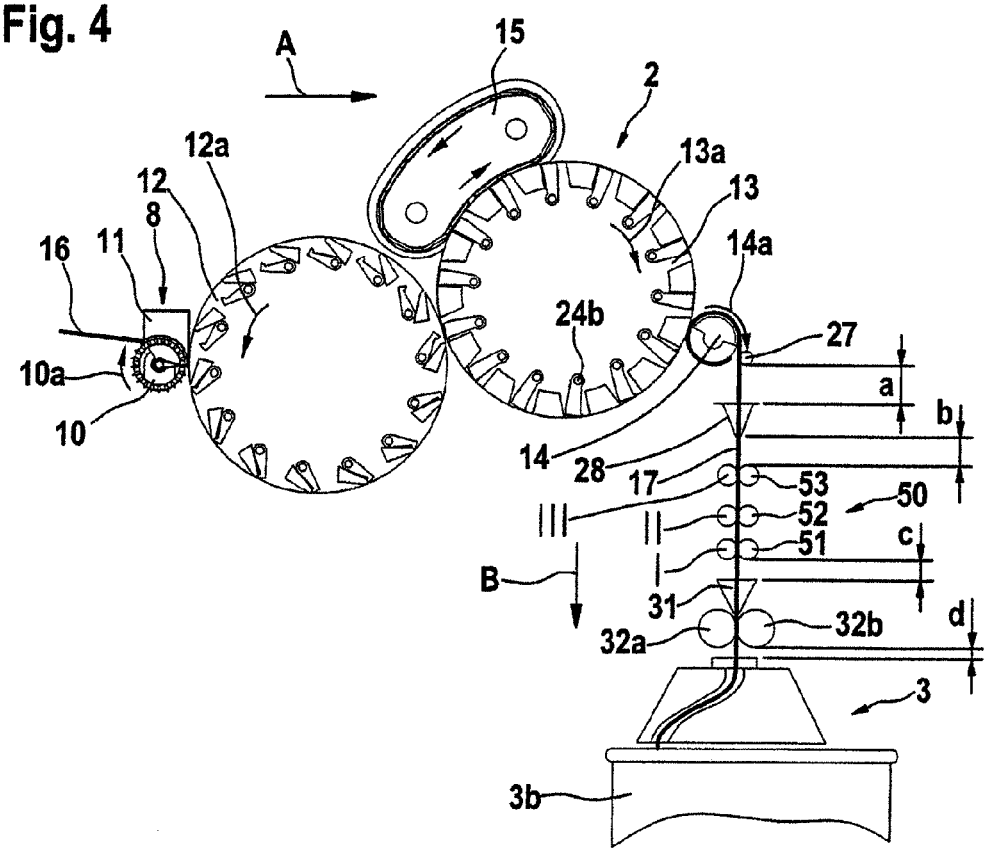
FIG. 4 shows an embodiment with a vertical arrangement of the drafting system above the fibre sliver-deposition device and with an ascending arrangement of the turning rotor and combing rotor.

In the construction illustrated in FIG. 4, the fibre sliver 17 is detached from the side of the take-off roller 14 remote from the combing rotor 13 and runs vertically in direction B through the drafting system 50 into the coiler head 3*a*.

FIG. 4 shows an embodiment with a vertical arrangement of the drafting system 50 above the sliver-deposition device 3 and an ascending arrangement of the turning rotor 12 and the combing rotor 13 is provided. The drafting system 50 is arranged beneath the take-off roller 14. Associated with the take-off roller—rotating clockwise—is a stripping roller 27, which rotates anticlockwise. The use of the stripping roller 27 having a defined clamping line serves for removal of the fibre material from the take-off roller 14 and guidance thereof vertically downwards (direction B) into a sliver funnel 28, to form a fibre sliver. The distance a of the clamping line between the rollers 14 and 27 and the inlet of the sliver funnel 28 is short. The drafting system 50 is arranged vertically below the sliver funnel 28, the distance b between the outlet of the region 28 and the feed roller pair 53/III of the drafting system 50 being short. Vertically below the drafting system 50 there is a sliver funnel 31 with two delivery rollers 32*a*, 32*b*, the distance c between the delivery roller pair 51/I of the drafting system 50 and the inlet of the sliver funnel 31 being short. The distance d is that between the delivery rollers 32*a*, 32*b* and the silver entry opening of the coiler head.

Figure 4A:
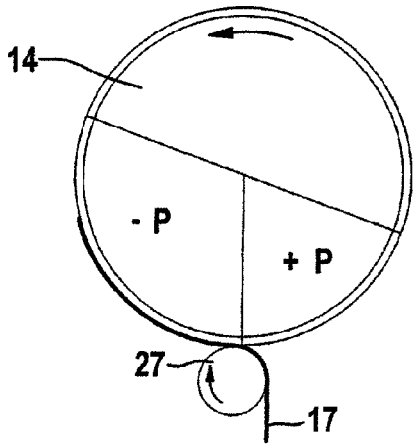
FIG. 4*a* shows an embodiment in which sliver removed from a combing rotor runs beneath a take-off roller to a stripping roller.

In one illustrative arrangement of take-off roller 14 shown in FIG. 4*a*, beneath the take-off roller 14*a* there is a stripping roller 27, which rotates clockwise and which, together with the take-off roller, forms a clamping machine. A reduced pressure region −P upstream of stripping roller 27 promotes retention of the pieced fibre web on the take-off roller 14, whilst an increased pressure region +P promotes removal of the web at the stripping roller 27. Analogous to the illustration in FIG. 4, the stripped-off fibre material runs in direction B through the drafting system 50 into the coiler head 3*a*.

Figure 5:
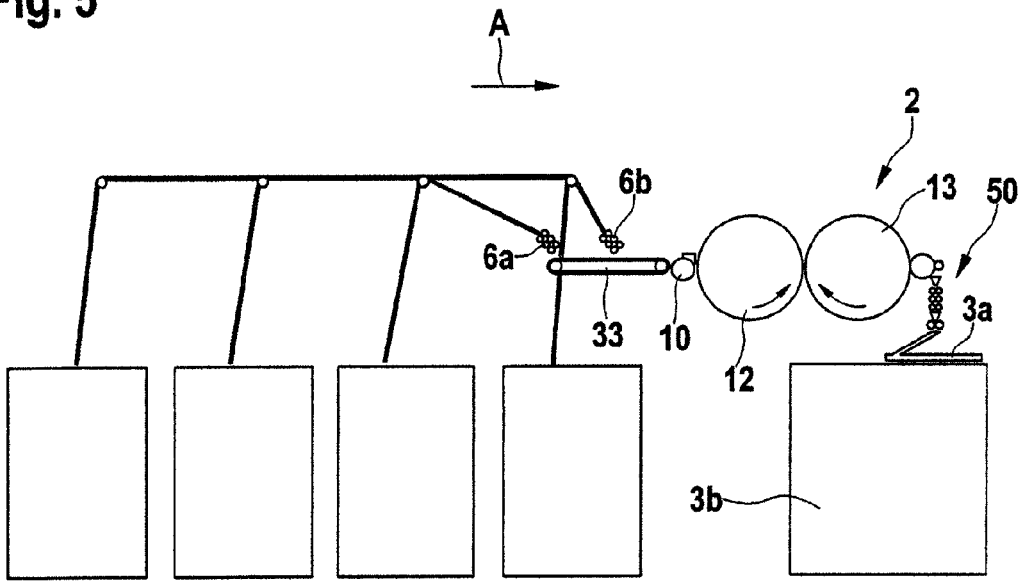
FIG. 5 shows a combing preparation device and—above the sliver-deposition device—a horizontal arrangement of the turning and combing rotors.

In the embodiment of FIG. 5, a combing preparation machine 1 is provided, and—above the sliver-deposition device 3—a horizontal arrangement of the turning and combing rotors and a vertical arrangement of the drafting system 50. The fibre material delivered by the drafting system 6*a*, 6*b* is supplied via a belt conveyor 33 to the feed roller 10 of the rotor combing machine 2.

Figure 6:
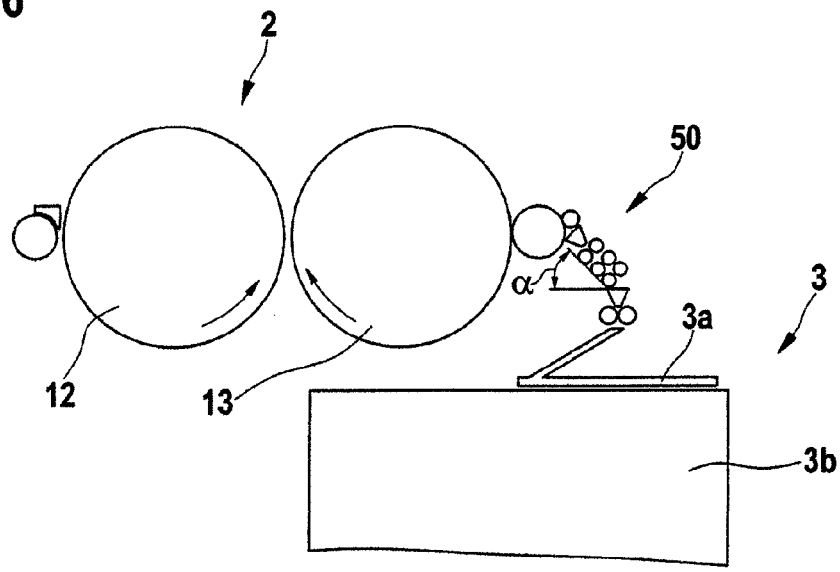
FIG. 6 shows, above the sliver-deposition device, a horizontal arrangement of the turning and combing rotors and an inclined arrangement of the drafting system.

In the embodiment of FIG. 6, a horizontal arrangement of the turning and combing rotors and an arrangement of the drafting system 50 inclined at an angle $\alpha$ is provided above the sliver-deposition device 3.

Figure 7:
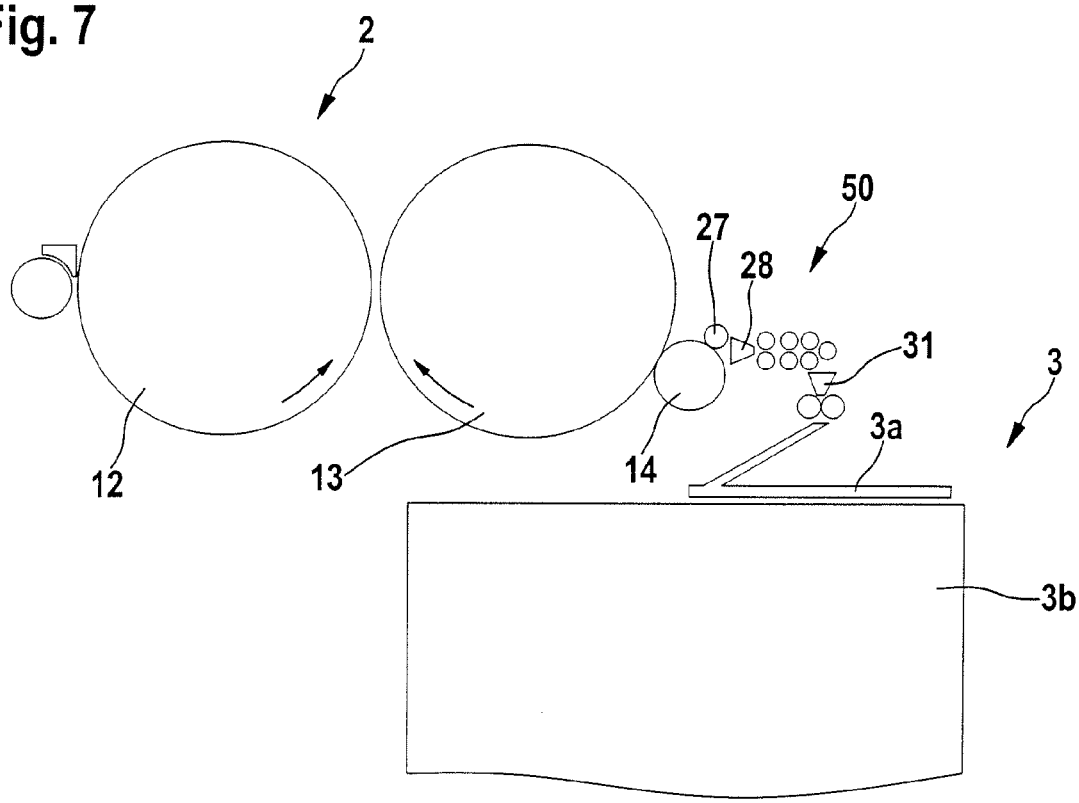
FIG. 7 shows, above the sliver-deposition device, a horizontal arrangement of the turning and combing rotors and a horizontal arrangement of the drafting system.

In the embodiment of FIG. 7, a horizontal arrangement of the turning and combing rotors and a horizontal arrangement of the drafting system 50 is provided above the sliver-deposition device 3. The sliver funnel 28 guides the fibre sliver directly into the feed rollers 53/III of the drafting system 50.

Figure 8:
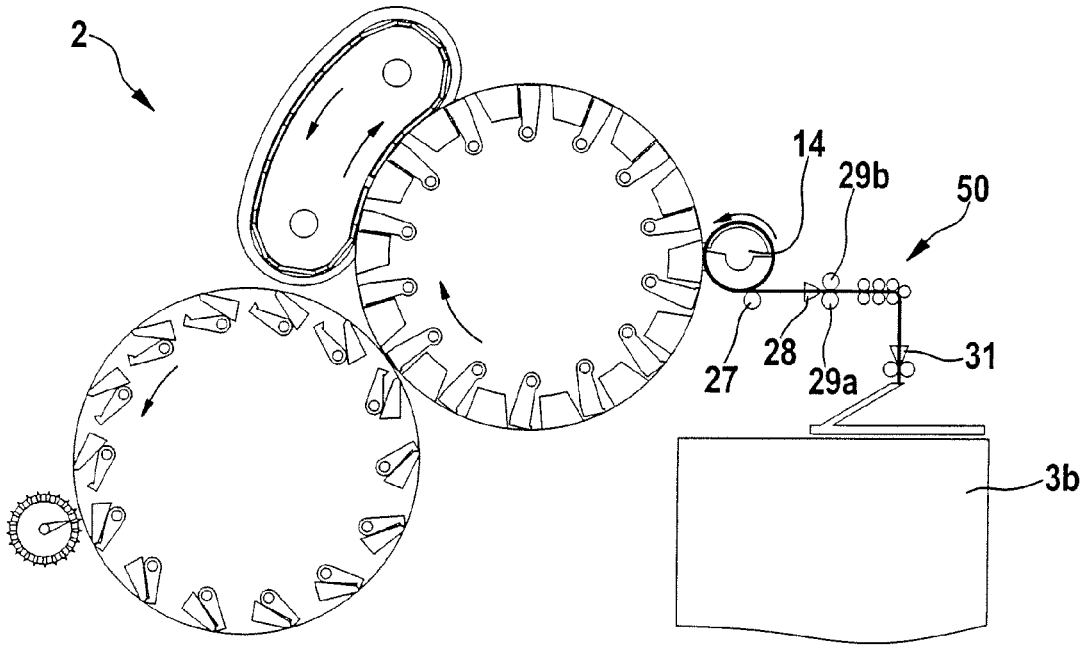
FIG. 8 shows an inclined arrangement of the turning and combing rotors and, above the sliver-deposition device, a horizontal arrangement of the drafting system.

In the embodiment of FIG. 8, an ascending arrangement of the turning and combing rotors is provided and, above the sliver-deposition device 3, a horizontal arrangement of the drafting system 50. Between the take-off roller 14 and the feed rollers 53/III of the drafting system 50 there is a sliver-forming device comprising sliver funnel 28 and delivery rollers 29*a*, 29*b*.

In the embodiments of FIGS. 2, 4 to 6 and 11, a 3-over-3 drafting system 50 is shown.

Figure 9:
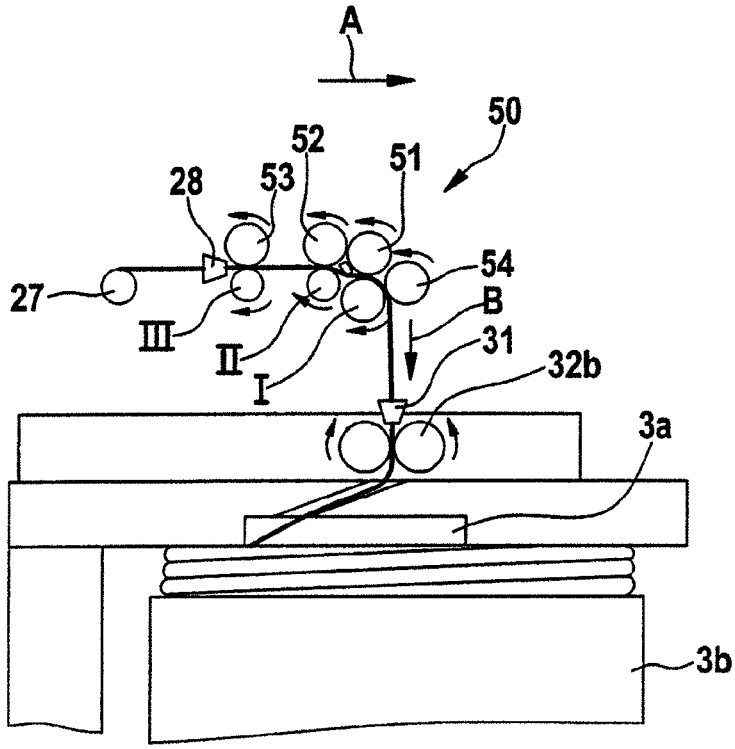
FIG. 9 shows an embodiment with a 4-over-3 drafting system.

The embodiments shown in FIGS. 7 and 8 include a 4-over-3 drafting system 50, which is explained in detail in relation to FIG. 9. The drafting system then consists of three bottom rollers I, II, III (I being the bottom delivery roller, II being the bottom middle roller and III being the bottom feed roller) and four top rollers 51 to 54. Drafting of the fibre sliver 17 takes place in the drafting system 50. The draft is made up of the preliminary draft and the main draft. The roller pairs 53/III and 52/II form the preliminary draft zone and the roller pairs 52/II and 51, 54/I form the main draft zone. The bottom delivery roller I is driven by a servo motor (not illustrated). The bottom feed and bottom middle roller III and II respectively are driven by a main motor (not illustrated) and thus determine the delivery speed. The direction of rotation of the rollers I, II and III, 51 to 54 is indicated by curved arrows. The fibre sliver 17 runs in the drafting system in direction A, between the feed rollers 53/III and the sliver entry opening into the revolving plate 3*a* in direction B. The rollers of the roller pairs 53/III, 52/II and 51, 54/I each have opposing directions of rotation. The 4-over-3 drafting system can also be used in the embodiment of FIG. 6.

Figure 10:
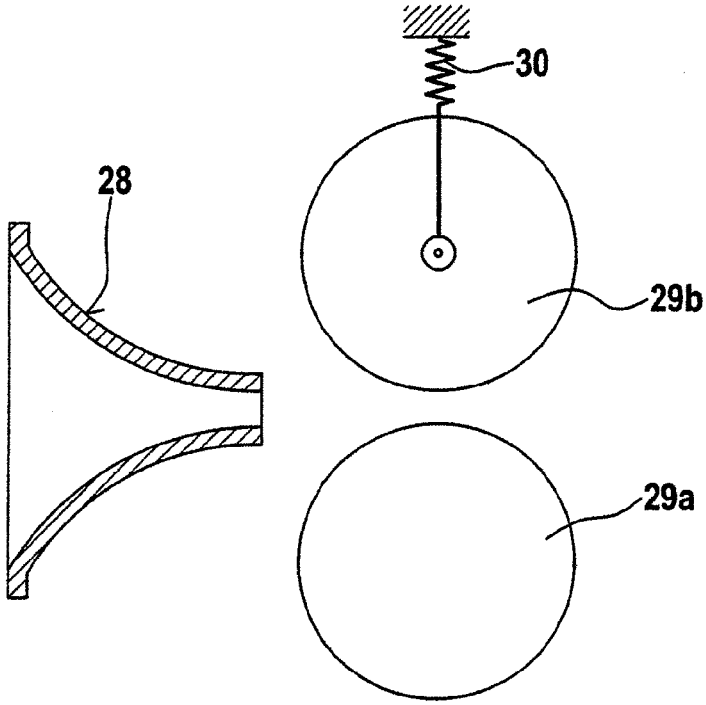
FIG. 10 is a diagrammatic side view of the sliver-forming unit with sliver funnel and delivery rollers.

FIG. 10 shows a sliver-forming element comprising sliver funnel 28 and delivery rollers 29*a*, 29*b*. The delivery roller 29*b* is movably arranged through loading by a spring 30.

Figure 11:
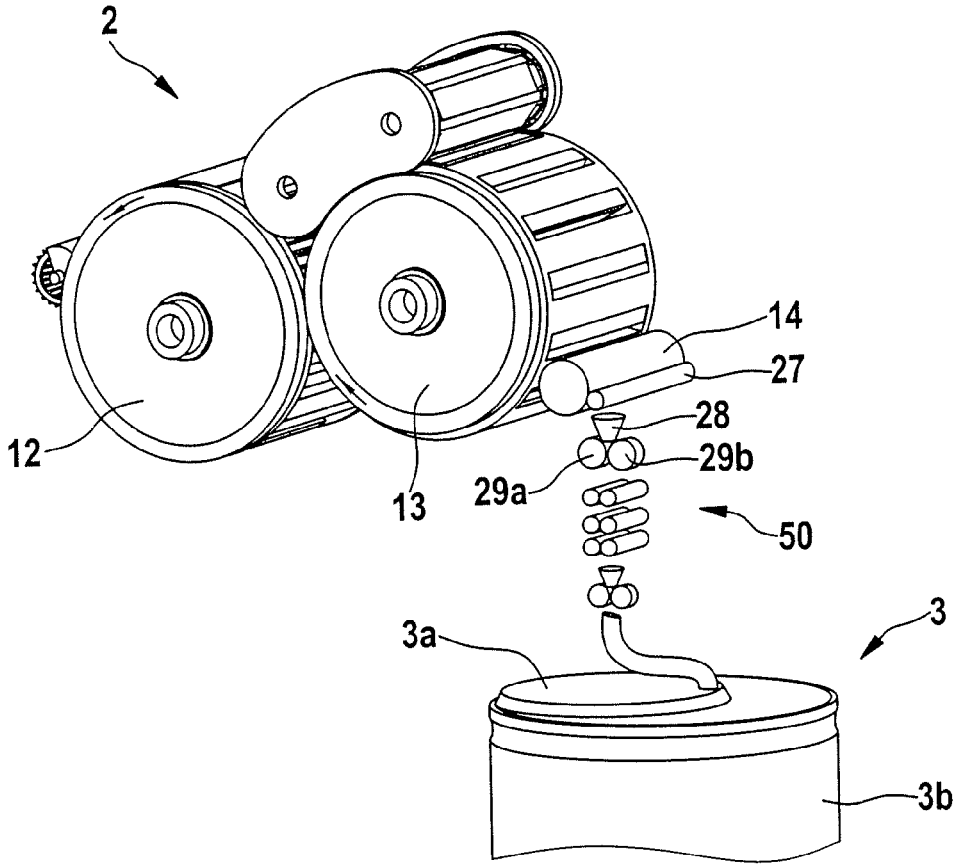
FIG. 11 is a diagrammatic perspective view of the rotor combing machine in accordance with FIG. 1 with drafting system and sliver-deposition device.
Figure 11A:
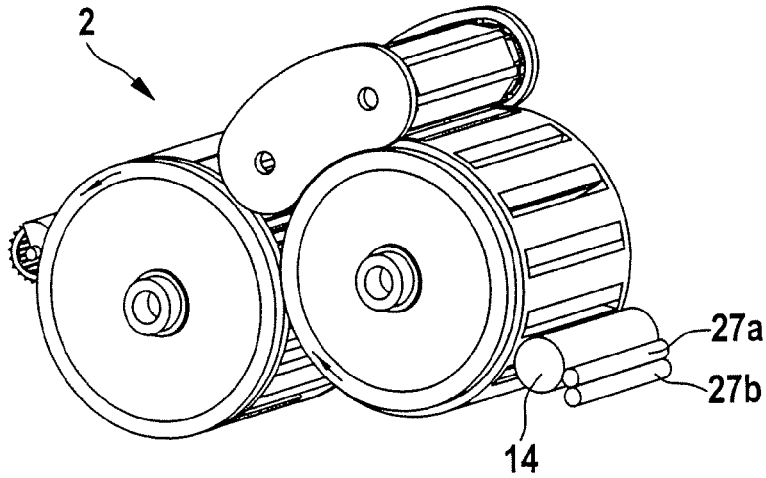
FIG. 11*a* is a diagrammatic perspective view of the rotor combing machine similar to that of FIG. 11 having two stripping rollers.

In FIG. 11, a rotor combing machine 2 according to FIG. 1 is shown, wherein the sliver-forming device (sliver funnel 28*a*, delivery rollers 29*a*, 29*b*), the drafting system 50 and the coiler head 3*a* and their arrangement and correlation, which differ from the corresponding features in FIG. 1, are shown in detail. Associated with the take-off roller 14 is the stripping roller 27, which rotates in the opposite direction to the take-off roller 14. In a variant shown in FIG. 11*a*, two stripping rollers 27*a*, 27*b* are associated with the take-off roller, which rotate in opposite directions with respect to one another.

Using the rotor combing machine 2 according to the invention, more than 2000 nips/min, for example from 3000 to 5000 nips/min, are achieved.

FIG. 12 shows a further possible arrangement for the rollers 12 and 13 of the fibre-sorting device 2, which arrangement may be used in combination with any of the exemplary embodiments of the take-off device and/or drafting system shown in FIGS. 4, 4*a*, 5 to 11 or 11*a* or the positioning of rollers 12, 13 shown in FIGS. 4 or 8.

In the rotor combing arrangement of FIG. 12, the rotatably mounted rollers 12 and 13 with clamping devices 19, 20 and 22, 23 respectively are additionally fitted with suction channels 52 and 56 respectively (suction openings) which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow at the suction openings 52, 56. The reduced pressure can be generated by connecting to a flow-generating machine. The suction flow at the individual suction openings 52, 56 can be so switched between reduced pressure region and suction opening that it is applied only at particular selected angular positions on the roller circumference. For the purpose of the switching, valves or a valve pipe 54, 58 with openings 55 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Additionally, a flow of blown air can be provided in the region of the supply device 8 and/or in the region of transfer between the rollers. The source of the flow of blown air (blowing nozzle 39) is arranged inside the feed roller 10 and acts, through the air-permeable surface of the supply device or through air passage openings, towards the outside in the direction of the first roller. Also, in the region of the supply device 8, the element for producing the blown air current can be fixedly arranged, directly under or over the supply device 8. In the region of the transfer between the rollers 12, 13 the blown air current sources can be arranged at the rotor perimeter of the first roller 12, directly under or over each nipper device. For the blown air generation there may be used compressed air nozzles or air blades.

The suction flow D is able not only to promote the deflection but also the process of separating the lap and the fibre tuft to be detached in the region of the supply device 8, and to shorten the time required for this. Suction flow E assists transfer of the fibre bundle between the roller 12 and the roller 13.

As a result of the provision of additional air guide elements 60 and lateral screens 61, 62 the direction of the flow can be influenced and the air carried round with the rotors separated off. In that way the time for alignment can be further shortened. In particular, a screen element between the first rotor 12 and supply device 8 over the lap and a screen element on each side of the roller have proved useful.

The combed-out fibre portion passes from the second roller 13 onto the piecing roller 14.

In use of the rotor combing machine according to the invention there is achieved a mechanical combing of the fibre material to be combed, that is, mechanical means are used for the combing. There is no pneumatic combing of the fibre material to be combed, that is, no air currents, e.g. suction and/or blown air currents, are used.

In the rotor combing machine according to the invention there are present rollers that rotate rapidly without interruption and that have clamping devices. Advantageously, rollers that rotate with interruptions, stepwise or alternating between a stationary and rotating state are not used.

The circumferential speeds are, for example, for the feed roller 10 about from 0.2 to 1.0 m/sec; the turning rotor 12 about from 2.0 to 6.0 m/sec; the combing rotor 13 about from 2.0 to 6.0 m/sec; the take off roller 14 about from 0.4 to 1.5 m/sec; and the revolving card top combing assembly 15 about from 1.5 to 4.5 m/sec. The diameter of the turning roller 12 and the combing roller 13 is, for example, about from 0.3 m to 0.8 m.

Although the foregoing invention has been described in detail by way of illustration and example for purposes of understanding, it will be obvious that changes and modifications may be practiced within the scope of the appended claims.

The invention claimed is:

1. An apparatus for the fiber-sorting or fiber-selection of a fiber bundle comprising textile fibres, the apparatus comprising:

a fiber-sorting device comprising at least a first roller and a second roller that rotate rapidly without interruption during use, at least one of the first and second rollers including clamping devices distributed about its periphery, the clamping devices adapted to clamp the fiber bundle;

a supply device adapted to supply the fiber bundle to the fiber-sorting device;

a mechanical combing device that generates a combing action in order to loosen and remove non-clamped constituents from the fiber bundle;

a take-off device adapted to remove the combed fiber material from the fiber-sorting device, the take-off device comprising a sliver-forming element adapted to form a combed sliver; and a drafting system having an inlet and an outlet;

wherein the sliver-forming element is located at the inlet of the drafting system, and the combed sliver formed by the sliver-forming element is supplied directly to the drafting system.

2. An apparatus according to claim 1, wherein the take-off device is located close to and in the region of the inlet of the drafting system.

3. An apparatus according to claim 1, further comprising a sliver-deposition device.

4. An apparatus according to claim 3, wherein the sliver-forming element is located close to and in the region of the sliver-deposition device.

5. An apparatus according to claim 4, wherein the drafting system comprises delivery rollers which are arranged close to and in the region of the sliver-deposition device.

6. An apparatus according to claim 3, wherein the sliver-deposition device is arranged downstream of the drafting system.

7. An apparatus according to claim 3, wherein the sliver-deposition device comprises a revolving plate having an inlet and the drafting system is arranged above the revolving plate.

8. An apparatus according to claim 7, wherein the sliver-deposition device comprises a sliver entry opening arranged at the inlet to the revolving plate and the outlet of the drafting system is arranged above the sliver entry opening.

9. An apparatus according to claim 7, wherein the sliver-deposition device comprises a sliver entry opening arranged at the inlet to the revolving plate and the outlet of the drafting system is arranged level with the sliver entry opening.

10. An apparatus according to claim 7, wherein the sliver-deposition device comprises a sliver entry opening arranged at the inlet to the revolving plate and the outlet of the drafting system is immediately upstream of the sliver entry opening.

11. An apparatus according to claim 7, wherein the distance between the outlet of the drafting system and the sliver entry opening is from about 5 to about 30 cm.

12. An apparatus according to claim 1, wherein the drafting system is arranged horizontally.

13. An apparatus according to claim 1, wherein the drafting system is arranged vertically.

14. An apparatus according to claim 1, wherein the drafting system is arranged at an angle to the horizontal.

15. An apparatus according to claim 1, wherein the sliver-forming element is a sliver funnel.

16. An apparatus according to claim 1, further comprising:

a leveling device including a measuring device that measures thickness of the fiber sliver, an electric regulation device, and an actuating device, wherein the actuating device comprises a servo motor that drives at least one roller pair of the drafting system.

17. An apparatus according to claim 16, further comprising a common control and regulation device connected to the servo motor, and drive motors of the rotor combing machine.

18. An apparatus according to claim 1, wherein the apparatus is arranged so that the material flow in the fiber-sorting device is ascending.

19. An apparatus according to claim 1, wherein the take-off device comprises a take-off roller and at least one stripping roller associated with the take-off roller.

20. An apparatus according to claim 1, wherein the fiber-sorting device, the take-off device and the drafting system are so arranged relative to one another that free space is present beneath the apparatus, the free space adapted to house sliver.

21. An apparatus according to claim 20, further comprising a device adapted to linearly move rectangular sliver cans beneath the first and second rollers.

22. An apparatus according to claim 1, wherein the second roller defines a circumference and a peripheral length along which the fiber bundle is conveyed, in use, wherein the peripheral length is greater than half the circumference.

23. An apparatus for the fiber-sorting or fiber-selection of a fiber bundle comprising textile fibres, the apparatus comprising:

a fiber-sorting device comprising at least a first roller and a second roller that rotate rapidly without interruption during use, at least one of the first and second rollers including clamping devices distributed about its periphery, the clamping devices adapted to clamp the fiber bundle;

a supply device adapted to supply the fiber bundle to the fiber-sorting device;

a mechanical combing device that generates a combing action in order to loosen and remove non-clamped constituents from the fiber bundle;

a take-off device adapted to remove the combed fiber material from the fiber-sorting device, the take-off device comprising a sliver-forming element adapted to form a combed sliver; and a drafting system having an inlet and an outlet;

wherein the sliver-forming element is adapted to supply the combed sliver formed by the sliver-forming element directly to the drafting system;

further wherein the first and second rollers comprise a turning rotor and a combing rotor, which rotate in opposite directions.

24. An apparatus according to claim 23, wherein the combing rotor is arranged downstream of and higher than the turning rotor.

* * * * *